United States Patent [19]

Bonnice

[11] 4,098,253

[45] Jul. 4, 1978

[54] GRINDING WHEEL DRESSER

[75] Inventor: Phillip E. Bonnice, Worthington, Ohio

[73] Assignee: General Electric Company, Worthington, Ohio

[21] Appl. No.: 677,112

[22] Filed: Apr. 15, 1976

Related U.S. Application Data

[62] Division of Ser. No. 535,016, Dec. 20, 1974, Pat. No. 4,068,416.

[51] Int. Cl.[2] ..... B24B 53/00

[52] U.S. Cl. ..... 125/11 R; 51/295; 51/305

[58] Field of Search ..... 125/11 R; 51/295, 305

[56] References Cited

U.S. PATENT DOCUMENTS

| | | | |
|---|---|---|---|
| 2,681,274 | 6/1954 | Young | 51/305 |
| 2,904,419 | 9/1959 | Couch | 51/295 |

OTHER PUBLICATIONS

FBM Bulletin, "Dressing A Grinding Wheel", vol. 16, No. 5, pp. 1541 & 1542, Oct. 1973.

*Primary Examiner*—Harold D. Whitehead

*Attorney, Agent, or Firm*—Dennis A. Dearing; Donald J. Voss; Frank L. Neuhauser

[57] ABSTRACT

A cubic boron nitride, diamond or similar grinding wheel is dressed by applying a dresser comprising a multiplicity of abrasive particles dispersed in a normally rigid but friction-meltable organic polymeric matrix against the rotating wheel and causing the dresser to melt and form a dressing slurry on the surface of the wheel and then pinching the slurry between the wheel and a workpiece until dressing is substantially complete.

5 Claims, 4 Drawing Figures

FIG. 1.
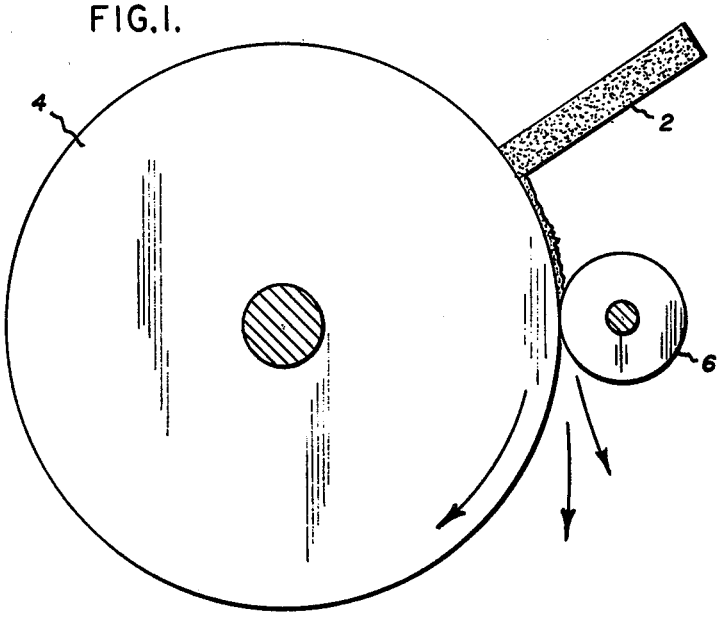
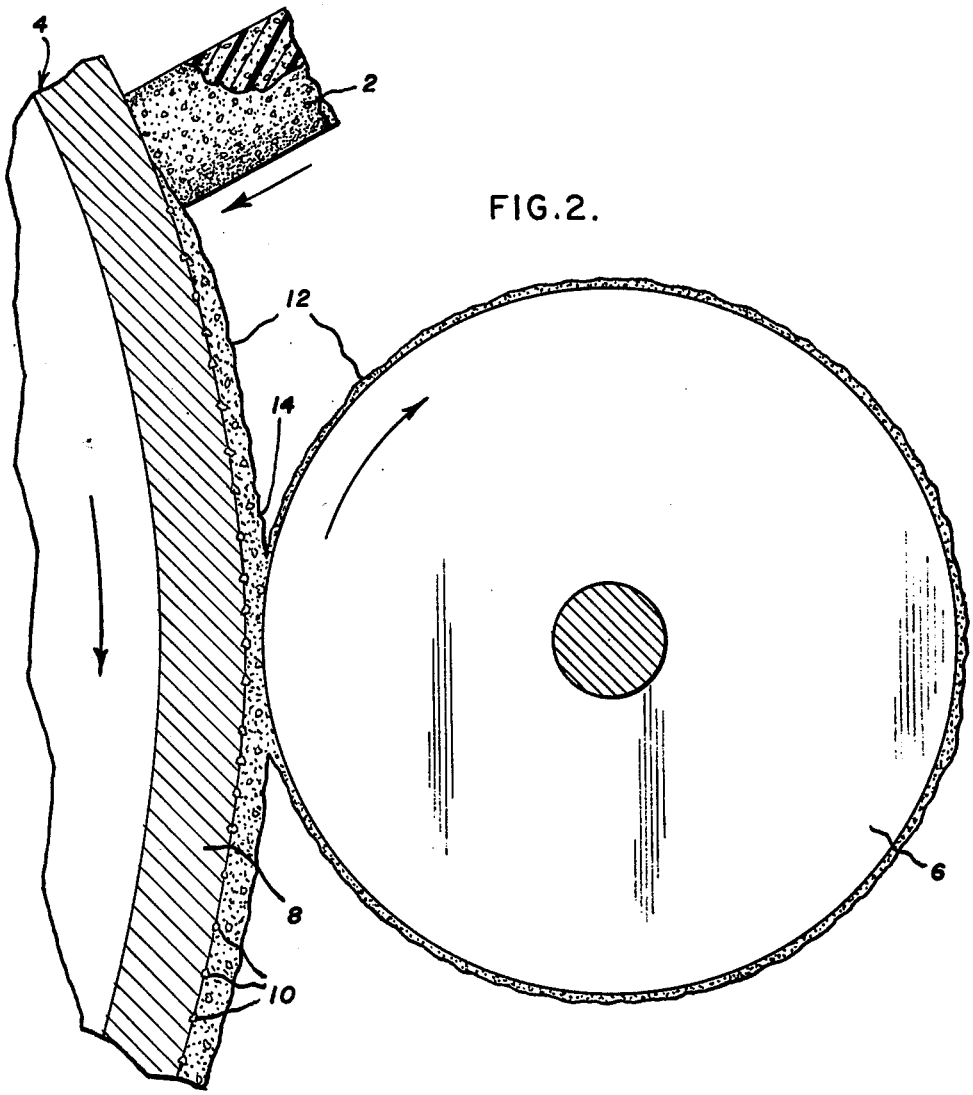
FIG. 2.

GRINDING WHEEL DRESSER

This is a division of application Ser. No. 535,016 filed Dec. 20, 1974 and now U.S. Pat. No. 4,068,416 dated 1-17-78.

This invention relates to a method for dressing abrasive containing grinding wheels and a dresser therefor.

BACKGROUND OF THE INVENTION

In machine grinding operations, it is necessary to dress the face of the grinding wheel to assure the proper shape of the part to be ground (the workpiece) and to prepare or restore the surface of the grinding wheel to optimize its cutting ability and to insure that the quality of finish imparted to a workpiece is high.

Conventionally, cutting wheels are dressed with a variety of tools, such as steel cutters, abrasive wheels, or techniques such as crush dressing are used. One means for dressing wheels in the past comprises using a rigid stick of abrasive material bonded in a hard matrix. These depend on the mechanical strength and hardness of the matrix and require continuous, forced application to break the conventional bonding material back away from the diamond, cubic boron nitride, aluminum oxide, silicon carbide or other materials used as the abrading materials in the wheels. See, for example, Abrams, U.S. Pat. No. 3,508,533.

Conventional sticks must be used with considerable force and this leads to economic losses caused by breakage and possible injury to the operator.

In addition, the force necessary with conventional sticks precludes their use in dressing form wheels where force destroys the form.

Moreover, conventional dressing of wheels in centerless grinders is economically disadvantageous because the time required is measured in hours.

An entirely new concept of wheel dressing has now been discovered which obviates the disadvantages of conventional dressing of grinding wheels of any size or form.

SUMMARY OF THE INVENTION

According to the present invention, a diamond, cubic boron nitride, silicon carbide, aluminum oxide, or obviously equivalent, grinding wheel is dressed by means of applying an abrasive compound in a normally rigid but friction-meltable matrix against the rotating wheel and causing the dressing composition to melt and form a dressing slurry on the surface of the wheel and then pinching the slurry between the wheel and a workpiece until dressing is substantially complete. Also provided by the invention is a wheel dresser which comprises a body of a multiplicity of abrasive particles dispersed in a friction-meltable organic polymeric matrix, which in preferred embodiments is in stick form adapted for hand application to the grinding wheel surface.

BRIEF DESCRIPTION OF THE DRAWINGS

The invention may be more readily understood by reference to the accompanying drawings in which:

FIG. 1 is a schematic view showing a grinding wheel dresser stick being applied to the surface of a cylindrical grinding wheel causing a dressing slurry to form and become pinched against a junction with a workpiece;

FIG. 2 is a somewhat enlarged view of the wheel, wheel dresser and workpiece combination shown in FIG. 1 illustrating in more detail the transfer of dressing compound to the moving surfaces;

DETAILED DESCRIPTION OF THE INVENTION

Figure 3:
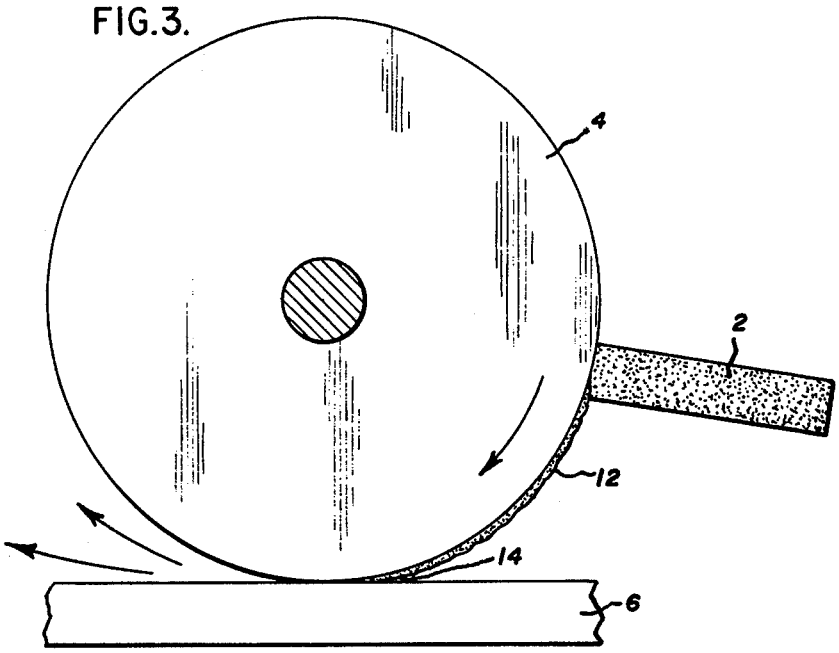
FIG. 3 is a schematic view showing dressing a wheel in a surface grinding embodiment according to this invention.

All of the following sizes, speeds and materials are illustrative only and referring to FIG. 1, grinding wheel dressing stick 2 is made by (i) melting a quantity of polyethylene glycol (PEG) of molecular weight of 1300–1600, 43–45° C. melting point (Baker Type U-220 or equivalent);

(ii) adding 100 grit aluminum oxide at a mix ratio of 0.6 g. of $Al_2O_3$ per ml. of polyethylene glycol;

(iii) stirring the mixture until completely mixed and the PEG begins to solidify;

(iv) pouring mixture into a mold and cooling (a refrigerator can be used to accelerate cooling -- and reduce sedimentation); and (v) removing the hardened stick from the mold and storing in a cool dry place until used. Grit size in U.S. Standard Sieve.

Wheel 4 is trued using a conventional trueing tool, then wheel 4 is set against workpiece 6 for zero clearance. The wheel, which has a size of 355 mm. $\phi \times 25.4$ mm., is turned on at a speed of 28M/sec. and stick 2 is applied to the moving rim. The workpiece is M 2 steel, HRC 62. The heat of friction melts the stick and the dressing proceeds (a trickle flow of coolant will sometimes shorten the time for dressing. Both stick 2 and workpiece 6 are infed as necessary to maintain contact with the work. As soon as the wheel is properly dressed, grinding can commence. With a water soluble polymer, such as PEG, residue from the stick can be washed off of the moving parts with liquid, such as the coolant water.

Further understanding can be obtained by reference to FIG. 2 in which wheel 4 comprises one having a wheel bond 8 in which are imbedded a plurality of inorganic crystals, e.g., cubic boron nitride abrasive grains 10. Polyethylene glycol stick 2 saturated with $Al_2O_3$ is placed lightly against wheel 4 which is rotating against hard metal workpiece 6. The heat of friction melts the stick and the resulting dressing compound film 12 is carried to the "pinch off" point 14 between wheel 4 and workpiece 6. The action at the interface causes abrasion against the wheel thereby dressing it. Unexpectedly light force only is needed.

Another way to dress a grinding wheel, a surface technique, is shown in FIG. 3. Here an abrasive wheel of 355 mm. $\phi \times 25.4$ mm. is brought to substantially zero clearance with the surface of a workpiece plate comprising M 2 steel, HRC 62. The wheel is rotated at a speed of 28M/sec. and stick 2, which is of polyethylene glycol saturated with 0.6 g./ml. of 100 grit $Al_2O_3$ is lightly brought down on the wheel. A film 12 of dressing compound forms and is carried to the "pinch off" point 14 and dressng proceeds. When the bond is cut back away from the grain, dressing is substantially complete.

Figure 4:
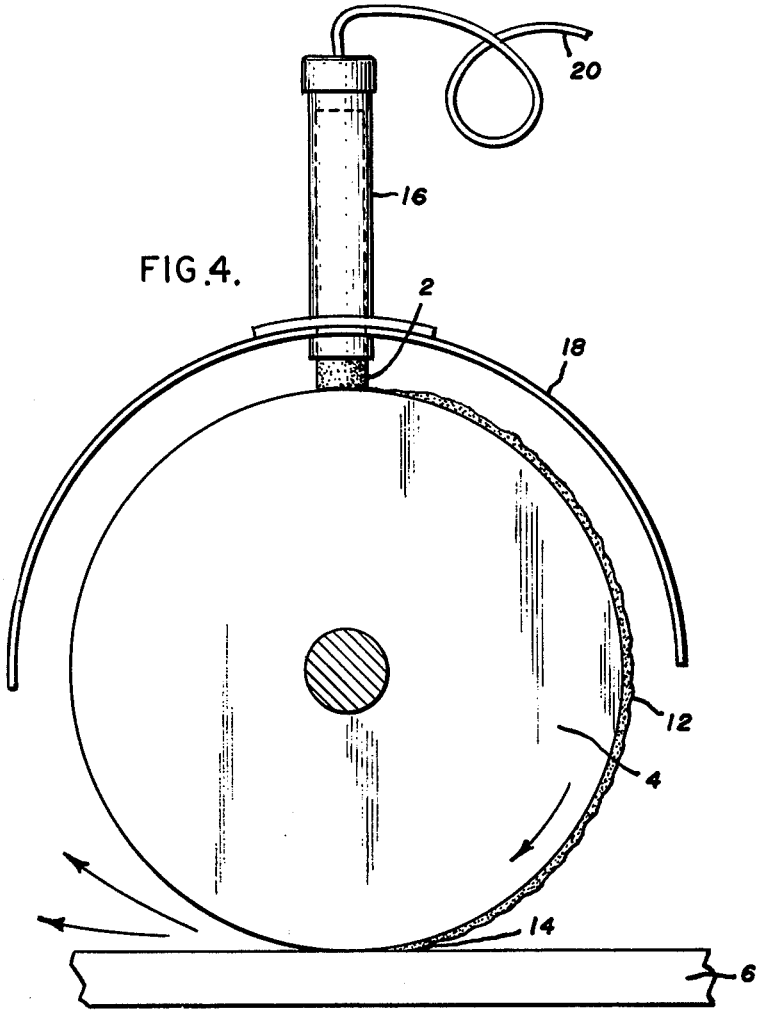
FIG. 4 is another schematic view showing surface dressing of a wheel according to this invention, wherein the dresser is in the form of a stick dispensed from a semi-automatic fixture.

The surface technique of FIG. 3 is readily adaptable to automatization. One such technique is shown in FIG. 4 in which stick dispenser 16 is installed in wheel guard 18 and stick 2 is fed against wheel 4, which is 355 mm $\phi$ × 25.4 mm. in size and rotating at 28M/sec. against a workpiece surface comprising M2 steel HRC 62. Conduit 20 is adapted to supply air or vacuum to stick dispenser 16 during use to feed the stick under air pressure or to suck it back and hold it when not in use.

It is thus evident that the present invention provides methods and dressers which are fast, effective and convenient. Obviously, many modifications will suggest themselves to those skilled in the art in view of the above detailed description. For example, instead of polyethylene glycol of the type described, one having a molecular weight of 1300 to 1600 and a melting point of 42° to 46° C. can be used. Other organic polymeric matrixes can be used, such as paraffin wax. Instead of a cubic boron nitride abrasive wheel, other abrasives can be used, such as diamond wheels. Instead of aluminum oxide crystals, others can be used such as cubic boron nitride, diamond silicon carbide, and the like. Instead of 100 and 200 grit size, the dressing compound grit can range from 60 to 1,000 . Instead of a mix ratio of 0.6 g./ml., other ratios, such as 0.4 to 1.5 g./ml. can be used. Wheel trueing can comprise a preferred preliminary step, using a conventional wheel-forming tool. Washing off the dressing compound is contemplated in many embodiments. If polyethylene glycol or other water soluble matrixes are used, the dressing compound retained by the wheel is easily removed with flushig or coolant water. Obviously, the wheel can be rotated first and the wheel dresser applied and then the wheel set against the workpiece, or vice versa, or the two operations can be carried out simultaneously. All such obvious variations are within the full intended scope of the inventionas defined by the appended claims.

I claim:

1. A grinding wheel dresser comprising:

a. a normally solid, friction-meltable matrix consisting of polyethylene glycol with a molecular weight of about 1300 to 1600 and melting point about 35° to 46° C; and b. a multiplicity of inorganic crystals dispersed in said matrix, said crystal having from 60 to 150 grit size.

2. A grinding wheel dresser as defined in claim 1 adapted to be held in the hand for application to the moving grinding wheel.

3. A grinding wheel dresser as defined in claim 1 wherein said inroganic crystals are aluminum oxide crystals.

4. A grinding wheel dresser as defined in claim 1 wherein said crystals are 100 grit aluminum oxide crystals and the mix ratio of aluminum oxide to polyethylene glycol being 0.4 to 1.5 g./ml.

5. A grinding wheel dresser as defined in claim 4 wherein the mix ratio of aluminum oxide to polyethylene glycol is about 0.6 g./ml.

* * * * *